US006850718B2

(12) United States Patent
Miyashita

(10) Patent No.: US 6,850,718 B2
(45) Date of Patent: Feb. 1, 2005

(54) IMAGE FORMING APPARATUS FOR ADJUSTING PREDETERMINED DEVELOPER DENSITY VALUES BASED ON A TARGET VALUE AND SENSED PATCH DEVELOPER DENSITY

(75) Inventor: Yoshiaki Miyashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 10/124,461

(22) Filed: Apr. 18, 2002

(65) Prior Publication Data

US 2002/0172523 A1 Nov. 21, 2002

(30) Foreign Application Priority Data

Apr. 19, 2001 (JP) ..... 2001-121455
Apr. 1, 2002 (JP) ..... 2002-098232

(51) Int. Cl.[7] ..... G03G 15/08
(52) U.S. Cl. ..... 399/49; 399/74
(58) Field of Search ..... 399/49, 74

(56) References Cited

U.S. PATENT DOCUMENTS

| | | | | |
|---|---|---|---|---|
| 5,198,852 | A | | 3/1993 | Mikami |
| 5,512,708 | A | | 4/1996 | Takahashi et al. |
| 5,547,793 | A | | 8/1996 | Kuramoto et al. |
| 5,557,373 | A | | 9/1996 | Miyashita et al. |
| 5,572,293 | A | | 11/1996 | Kikuchi et al. |
| 5,574,538 | A | | 11/1996 | Takahashi et al. |
| 5,585,896 | A | | 12/1996 | Yamazaki et al. |
| 5,605,777 | A | | 2/1997 | Ando et al. |
| 5,753,400 | A | | 5/1998 | Kuramoto et al. |
| 5,873,011 | A | | 2/1999 | Takemoto et al. |
| 5,991,558 | A | * | 11/1999 | Emi et al. ..... 399/49 |
| 6,047,758 | A | | 4/2000 | Kuramoto et al. |
| 6,055,011 | A | | 4/2000 | Nishimura |
| 6,095,164 | A | | 8/2000 | Saitoh et al. |
| RE36,963 | E | | 11/2000 | Ando et al. |
| RE37,645 | E | | 4/2002 | Takahashi et al. |

FOREIGN PATENT DOCUMENTS

| | | | |
|---|---|---|---|
| JP | 63-148282 | * | 6/1988 |
| JP | 2-281269 | * | 11/1990 |
| JP | 5-302892 | | 11/1993 |
| JP | 5-323706 | * | 12/1993 |
| JP | 6-148994 | | 5/1994 |
| JP | 9-319180 | | 12/1997 |
| JP | 11-258873 | | 9/1999 |

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus of the present invention includes an image carrier on which a developer is to be deposited by an electrophotographic system. A controller controls the amount of the developer to deposit on the image carrier by varying a potential for development. A reflection type sensor for sensing the amount of the developer deposited on the image carrier is made up of a light source and a light-sensitive device for. An adjusting device adjusts a set value set in the controller for controlling the amount of the developer to a target value. The sensor is of a diffuse reflection system and has a correcting function. The adjusting device causes the sensor to sense the amount of the developer deposited on a test patch, which is formed on the basis of a preselected set value, and then calculates an adjustment value of the set value on the basis of the amount sensed by the sensor and the target value.

8 Claims, 6 Drawing Sheets

IMAGE FORMING APPARATUS FOR ADJUSTING PREDETERMINED DEVELOPER DENSITY VALUES BASED ON A TARGET VALUE AND SENSED PATCH DEVELOPER DENSITY

BACKGROUND OF THE INVENTION

1. Field of the Invention

The present invention relates to a copier, printer, facsimile apparatus or similar electrophotographic image forming apparatus. More particularly, the present invention relates to an image forming apparatus of the type forming a test patch with a preselected set value and then sensing the amount of toner deposited on the test patch for controlling image density.

2. Description of the Related Art

An electrophotographic image forming apparatus usually includes an image carrier, e.g., a photoconductive element caused to rotate by a motor. While the image carrier is in rotation, a charger uniformly charges the surface of the image carrier to a preselected potential. An exposing unit exposes the charged surface of the image carrier imagewise to thereby form a latent image. A developing device develops the latent image for thereby producing a corresponding toner image. An image transfer unit transfers the toner image to a sheet or recording medium. In a full-color mode, such a process is repeated color by color for forming toner images of different colors on the image carrier one above the other and then transferring the resulting full-color image to a sheet. Alternatively, toner images of different colors may be sequentially formed on the image carrier while being transferred to a sheet one by one.

In a potential control system available with the image forming apparatus, a latent image representative of a patch pattern, or reference latent image, is formed on the image carrier and then developed by the developing device. The control system measures a developing characteristic based on the surface potential of the patch pattern and the amount of toner deposited thereon. The control system then determines, based on the developing characteristic, various potentials including a bias potential for development and a potential to which the image carrier should be charged. For example, a specific potential control system uses a plurality of patch patterns and reference values corresponding one-to-one to the patch patterns and compares each reference value and the amount of toner deposited on a particular patch pattern, thereby determining various potentials. Another specific potential control system senses the surface potentials of patches and the amounts of toner deposited thereon with a sensor and then linearly approximates a developing characteristic by using the resulting data. The system then determines various potentials by using the slope of the linear approximation as a developing efficiency.

However, it is extremely difficult with the potential control system described above to determine a reference value. Particularly, when a developer used is noticeably susceptible to environment or aging, the algorithm used to control various potentials becomes difficult because the influence of the varying environment or agent should be avoided. As a result, an extremely long period of time is necessary for the potentials to become stable. The control system of the type relying on linear approximation fails to achieve sufficient accuracy against the variation of the developer and that of the image carrier, resulting in unstable potential control. This is particularly true when such a control system is applied to a full-color copier extremely susceptible to potential variation; stability is short in the highlight portion of a full-color image among others.

A current trend in the imaging art is toward an electrophotographic image forming apparatus not including a potential sensor. This is directed toward cost reduction. Moreover, recent control over the quantity of exposing light is shifting from multilevel control (e.g. 256 tones) to two-level or four-level control, preventing latent image control using a potential sensor from being fed back to the quantity of light.

The control using such a small number of levels is implemented by the recent resolution as high as 600 dpi (dots per inch) or 1,200 dpi, which is far greater than the conventional 300 dpi or 400 dpi. The high resolution reduces the size of a single dot and therefore allows halftone to be rendered without resorting to delicate control over the quantity of light. Further, in parallel with an increase in the number of prints from the order of several prints to the order of several ten prints, the load that a CPU (Central Processing Unit) bears is increasing. The control using a small number of levels serves to reduce the load on the CPU.

Under the above circumstances, development potential control, which is the extension of the traditional potential control, is predominant as control of the type using a sensor responsive to the amount of toner deposition. Generally, the development potential control forms a number of patches by varying a development potential, which is a difference between a bias for development and the surface potential of an image carrier. A photosensor senses the amount of toner deposited patch by patch. The sensed amounts of toner are used to determine a relation between the development potential and the amount of toner deposition. This relation is, in turn, used to determine the conditions of an image forming apparatus. Consequently, the characteristic of the apparatus is produced in the form of scattered values each corresponding to a particular patch. The scattered values are subjected to linear approximation for determining a development potential that implements a target amount of toner deposition. In practice, a development bias, a charge potential and a quantity of light, for example, are determined that control the development potential.

A sensor using diffuse reflection light has been proposed for the above-described density control of the type using a plurality of patches. This kind of sensor is capable of sensing the amount of toner deposition, i.e., image density with high accuracy.

The multi-point type of density control stated above has a problem that it must form a number of patches with different development potentials. Another problem is that the calculations including the linear approximation extend a period of time necessary for control. Although the diffuse reflection type of sensor may make up for the short accuracy of linear approximation, it cannot reduce the processing time. In addition, toner is consumed in an amount corresponding to the number of patches, increasing the running cost of the apparatus.

Technologies relating to the present invention are disclosed in, e.g., Japanese Patent Laid-Open Publication Nos. 5-302892, 6-148994, 9-319180 and 11-258873.

SUMMARY OF THE INVENTION

It is an object of the present invention to provide an image forming apparatus capable of accurately controlling the amount of toner deposition or image density to a target value without resorting to a number of test patches or linear approximation and therefore in a short period of time with a minimum of toner consumption, thereby insuring an adequate, stable amount of toner deposition.

An image forming apparatus of the present invention includes an image carrier on which a developer is to be deposited by an electrophotographic system. A controller controls the amount of the developer to deposit on the image carrier by varying a potential for development. A reflection type sensor for sensing the amount of the developer deposited on the image carrier is made up of a light source and a light-sensitive device for. An adjusting device adjusts a set value set in the controller for controlling the amount of the developer to a target value. The sensor is of a diffuse reflection system and has a correcting function. The adjusting device causes the sensor to sense the amount of the developer deposited on a test patch, which is formed on the basis of a preselected set value, and then calculates an adjustment value of the set value on the basis of the amount sensed by the sensor and the target value.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
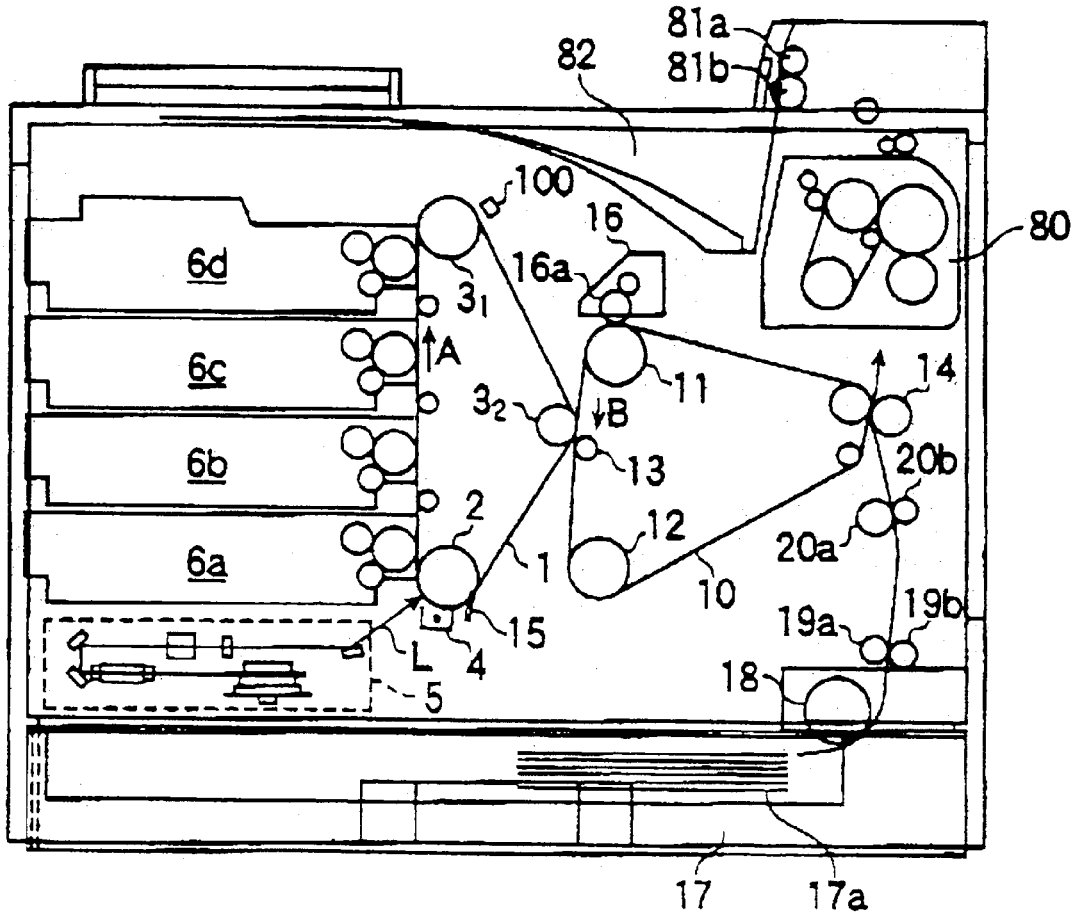
FIG. 1 is a view showing a color image forming apparatus embodying the present invention.

Referring to FIG. 1 of the drawings, a color image forming apparatus embodying the present invention is shown. While the illustrative embodiment is applied to, e.g., a color copier, it is, of course, applicable to monochromatic image forming equipment. As shown, the color image forming apparatus includes a flexible, photoconductive belt 1, which is a specific form of an image carrier for carrying a toner image thereon. The photoconductive belt 1 (simply belt 1 hereinafter) is passed over a drive roller 2 and driven rollers $\mathbf{3}_1$ and $\mathbf{3}_2$. The drive roller 2 causes the belt 1 to turn in a direction indicated by an arrow A in FIG. 1 (clockwise), i.e., in the subscanning direction. A charger 4, a laser writing unit 5 and color developing units 6*a*, 6*b*, 6*c* and 6*d* adjoin the belt 1 for forming a latent image on the belt 1 and then developing it with toner. The color developing units 6*a*, 6*b*, 6*c* and 6*d* store magenta (M) toner, cyan (C) toner, yellow (Y) toner and black (Bk) toner, respectively. Such toner is a single-ingredient type developer as distinguished from a toner and carrier mixture or two-ingredient type developer.

An intermediate image transfer belt 10 intervenes between the belt 1 and a sheet or recording medium as to image transfer. The intermediate image transfer belt 10 (simply belt 10 hereinafter) is passed over a drive roller 11 and a driven roller 12. The drive roller 11 causes the belt 10 to turn in a direction indicated by an arrow B in FIG. 1 (counterclockwise). The two belts 1 and 10 contact each other at a position where the driven roller $\mathbf{3}_2$ is located. A conductive, bias roller 13 is held in contact with the inner surface if the belt 10 under a preselected condition at the above position.

A sheet cassette 17, a pickup roller 18, a pair of rollers 19*a* and 19*b* and a pair of registration rollers 20*a* and 20*b* constitute a sheet feeding section. An image transfer roller 14, a fixing unit 80, a pair of outlet rollers 81*a* and 81*b* and a print tray 82 deal with sheets sequentially fed from the sheet feeding section.

In operation, while the charger 4 uniformly charges the surface of the belt 1 to a preselected potential, the laser writing unit 5 scans the charged surface of the belt 1 with a laser beam L in accordance with image data. As a result, a latent image is formed on the belt 1. More specifically, the image data is one of M, C, Y and Bk image data produced by separating a desired full-color image. A semiconductor laser included in the laser writing unit 5 emits the laser beam L in accordance with such image data.

The color developing units 6*a* through 6*d* each develop associated one of latent images sequentially formed on the belt 1 with one of M, C, Y and Bk toner, thereby producing a corresponding toner image of particular color. The bias roller 13, which is applied with a preselected bias, sequentially transfers the resulting M, C, Y and Bk toner images from the belt 1 to the belt 10 one above the other, completing a full-color image. At this instant, the belt 10 is rotating in synchronism with the belt 1.

A sheet 17*a* is fed from the sheet cassette 17 to an image transfer position where the image transfer roller 14 is positioned via the pickup roller 18, rollers 19*a* and 19*b* and registration rollers 20*a* and 20*b*. The image transfer roller 14 transfers the full-color image from the belt 10 to the sheet 17*a*. The fixing unit 80 fixes the full-color image on the sheet 17*a*. The sheet or print 17*a* is then driven out to the print tray 82 via the outlet rollers 81*a* and 81*b*.

After the image transfer from the belt 1 to the belt 10, a cleaning blade 15, which is held in contact with the belt 1, removes the toner left on the belt 1. Likewise, a cleaning device 16 cleans the surface of the belt 10 with a brush roller 16*a*. The brush roller 16*a* is spaced from the surface of the belt 10 during image formation and then brought into contact with the belt 10 after the image transfer from the belt 10 to the sheet 17*a*.

If desired, the belts 1 and 10, charger 4, cleaning blade 15 and cleaning device 16 may be constructed into a single process cartridge removable from the body of the image forming equipment.

Figure 2:
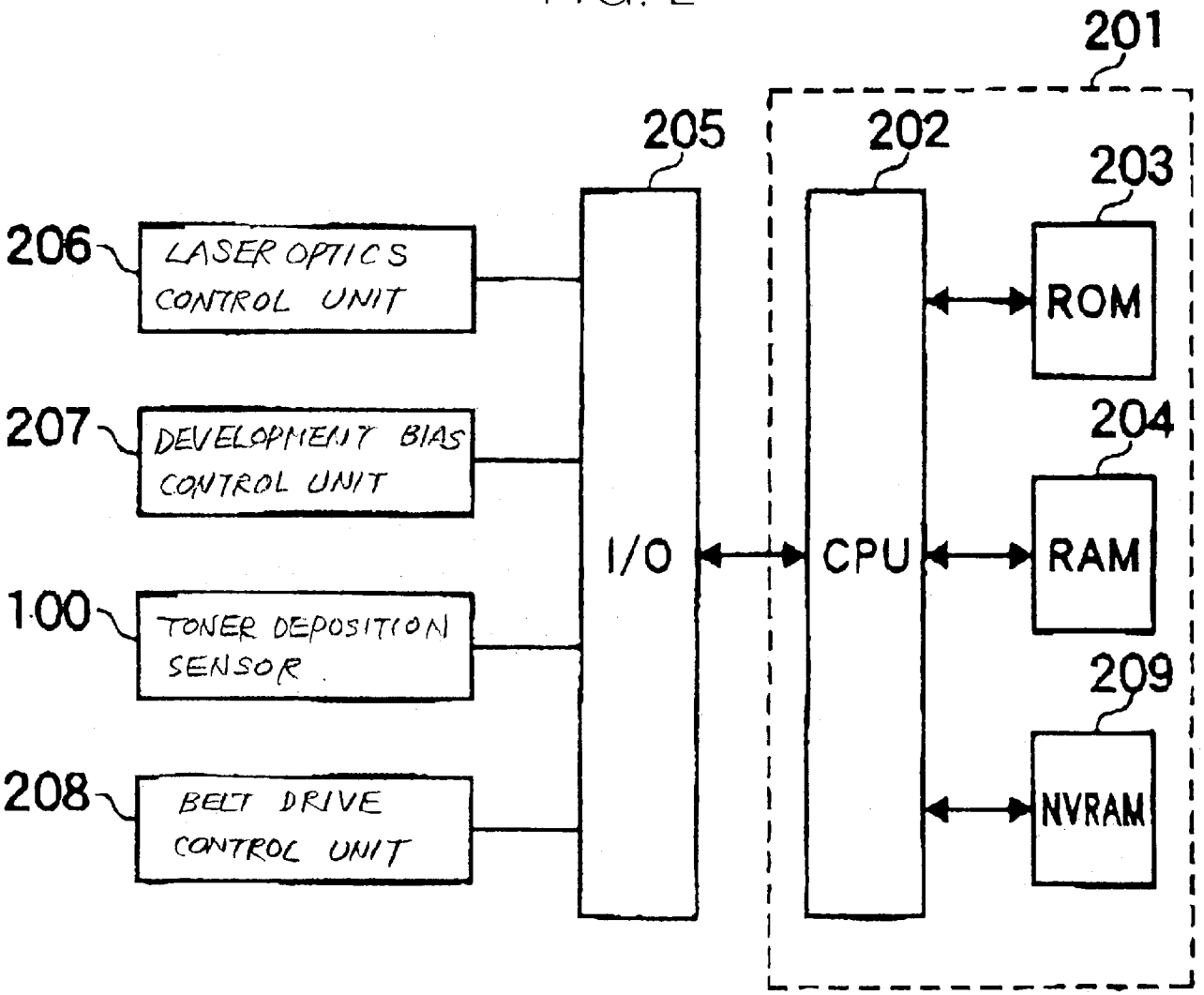
FIG. 2 is a block diagram schematically showing a control system included in the illustrative embodiment.

FIG. 2 shows a control system for controlling the color image forming apparatus described above. As shown, the control system is generally made up of a main control unit 201 and a plurality of peripheral control units. The main control unit 201 controls the entire image forming procedure described with reference to FIG. 1. As shown, the main control unit 201 includes a CPU 202, a ROM (Read Only Memory) 203, a RAM (Random Access Memory) 204, and an NVRAM (NonVolatile RAM) 209. The ROM 203 stores a control program and various fixed data. The RAM 204 plays the role of a work area for storing interim data. The NVRAM 209 stores various parameters for determining operating conditions and information necessary for management.

A laser optics control unit 206, a development bias control unit 207, a toner deposition sensor 100 and a belt drive control unit 208, which are the peripheral units, are connected to the main control unit 201. The laser optics control unit 206 controls the laser writing unit 5. The development bias control unit 207 controls the bias for development to be applied to each of the color developing units 6*a* through 6*d*. The belt drive control unit 208 controls the drive of the two belts 1 and 10. The peripheral control units 206, 207 and 208 all execute control in accordance with commands output from the CPU 202. The toner deposition sensor 100 senses the amount of toner deposited on the belt 1 under a preselected condition and sends its output to the CPU 202. In response, the CPU 202 determines a value by which the bias for development should be adjusted in accordance with the amount of toner deposited on the belt 1. The CPU 202 then sets the above adjustment value in the development bias control unit 207 so as to effect image density control.

Image density control will be described in detail hereinafter. It is a common practice with an image forming apparatus to sense the amount of toner deposited on an image carrier with a sensor and feed back a development bias or similar development potential based on the above amount as a control amount for thereby stabilizing the amount of toner deposition. The conventional procedure for this kind of control is required to form a number of test patches and then effect linear approximation based on the sensed densities of the test patches, as discussed earlier. By contrast, the illustrative embodiment can accurately control the amount of toner deposition (image density) to a target value without resorting to the above procedure, i.e., in a shorter period of time with a minimum amount of toner consumption. For example, the illustrative embodiment is capable of effecting the control even with a single test patch.

Figure 4:
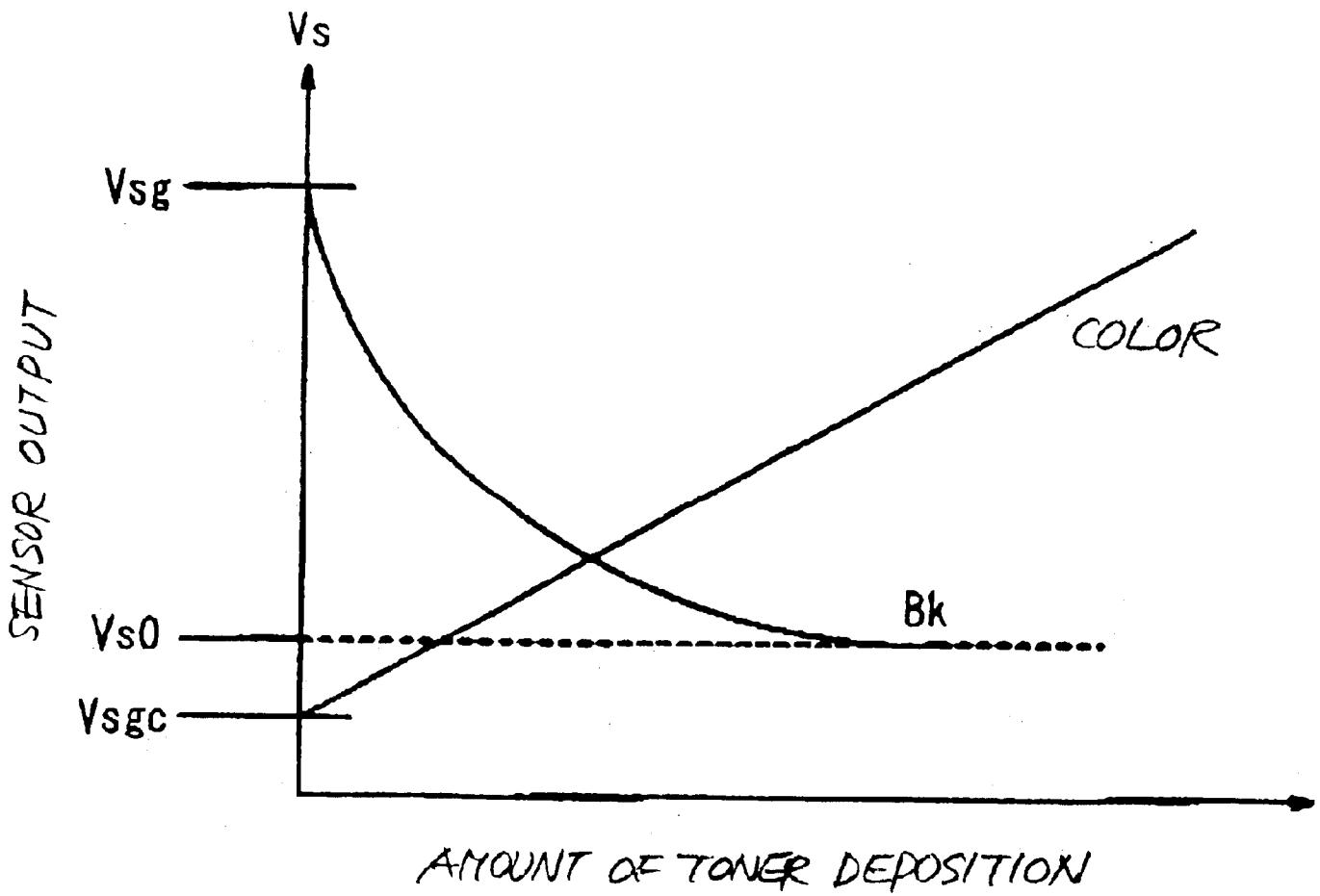
FIG. 4 is a graph representative of the characteristics of a diffuse reflection type of sensor applied to the illustrative embodiment.
Figure 5:
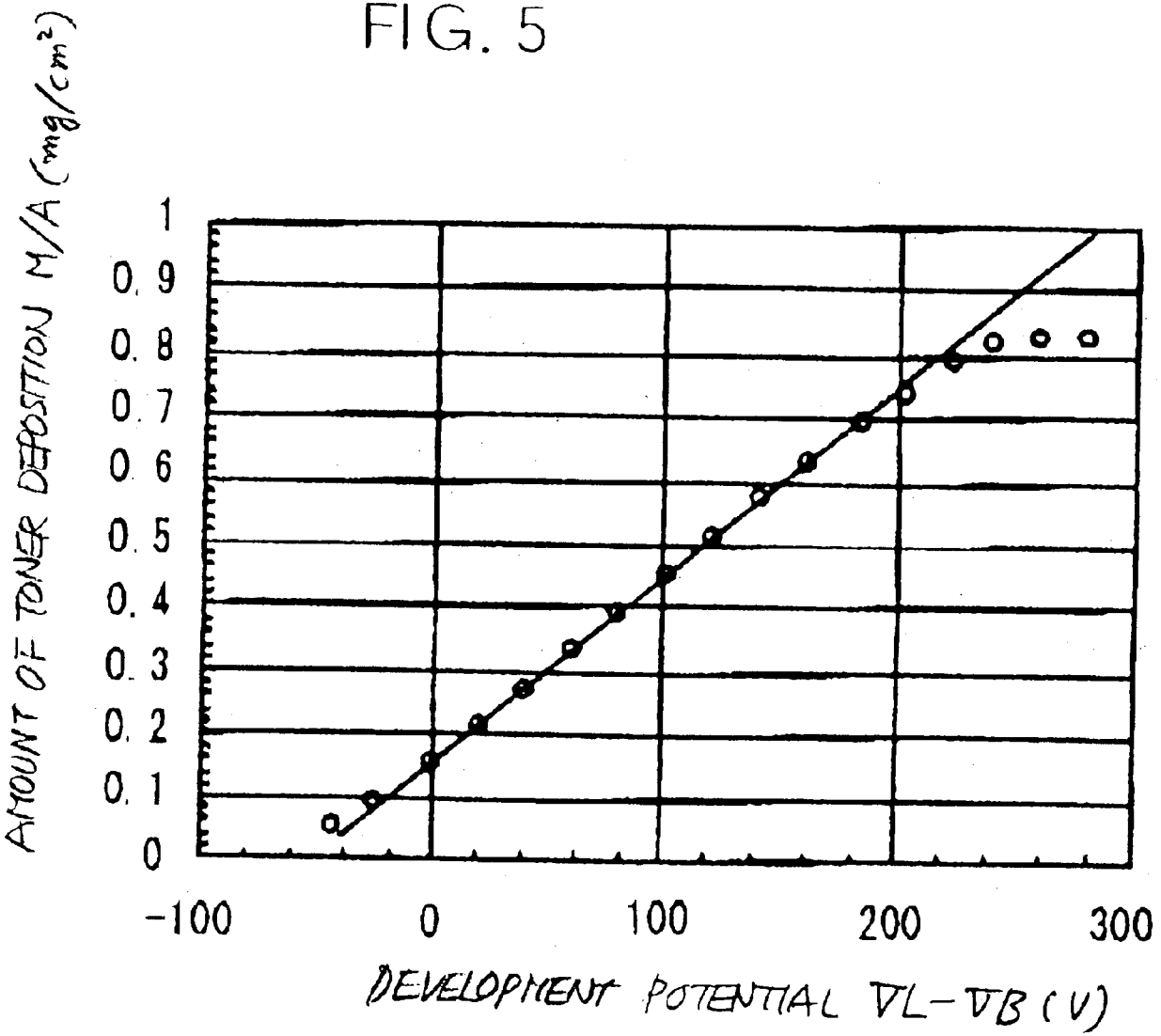
FIG. 5 is a graph showing a relation between the development potential and the amount of toner deposition representative of the characteristic of a developing device.

A first precondition that implements the control with a single test patch is that the amount of toner deposition and the sensor output be linearly related to each other over the range of toner deposition (see "Color", FIG. 4). A second precondition is that the amount of toner deposition and the development potential be linearly related to each other over the range of toner deposition. As for the second precondition, as shown in FIG. 5, the relation is linear at and around the amount of toner deposition of 0.6 $mg/cm^2$ implementing ID (Image Density) of 1.5, which is the target of the illustrative embodiment.

In the illustrative embodiment, the sensor output refers to the output of the toner deposition sensor 100, FIG. 2, responsive to the amount of toner deposited on the belt 1. Alternatively, the toner deposition sensor 100 may sense the amount of toner deposited on the belt 10, if desired. The toner deposition sensor 100 is of the type including an infrared light emitting diode (LED) and a diffuse reflection type of light-sensitive section implemented by a photodiode. The sensor 100 outputs a voltage representative of the quantity of light incident to the photodiode. FIG. 4 shows the characteristics of this type of sensor with respect to M, C, Y and Bk color toner, as distinguished from a toner and carrier mixture.

In FIG. 4, the ordinate and abscissa indicate the sensor output (voltage) and the amount of toner deposition, respectively. As shown, the sensor output is linearly related to the amount of toner deposition as for M, C and Y toner, as represented by an upward, rightward line, showing constant sensitivity. This characteristic is particular to a diffuse reflection type of sensor. By contrast, as for Bk toner, the sensor output falls rightward and saturates when the amount of toner deposition increases.

In the event of image density control, the output of the toner deposition sensor 100 representative of the density of the test patch must be free from errors. It is therefore necessary to correct the toner deposition sensor 100 such that its output characteristics remain constant. For this purpose, by using the characteristic relating to Bk toner shown in FIG. 4, the illustrative embodiment adjusts the quantity of light to issue from the infrared LED. The result of adjustment is reflected by the characteristics relating to M, C and Y toner that share the same LED with Bk toner. This maintains the sensor characteristic constant for all of the color toner.

More specifically, assume that in a Bk toner sensing mode, the sensor output is Vsg when toner is absent on the image carrier or Vs0 when the amount of Bk toner deposition is increased to the saturation level. Then, the illustrative embodiment adjusts the quantity of light to issue from the infrared LED such that a difference Vsg−Vs0 remains constant, thereby maintaining the sensor output level constant. In practice, the sensor output appearing when the infrared LED is in an OFF state is equal to the sensor output at the saturation level. The illustrative embodiment therefore senses the sensor output appearing when the infrared LED is in an OFF state as Vs0, which is about 1.1 V in the illustrative embodiment. Subsequently, while sensing the output Vsg when toner is absent on the belt 1, the illustrative embodiment adjusts the quantity of light such that the difference Vsg−Vs0 reaches a preselected value, which is 1.5 V in the illustrative embodiment.

Hereinafter will be described a specific procedure for controlling, based on the output of the toner deposition sensor with the diffuse reflection type of light-sensitive section, the actual amount of toner deposition to the target value. The CPU 202 of the main control unit 201 may execute the procedure by starting the program at any suitable timing. More preferably, when a power switch is turned on or on the recovery from a power saving mode, the CPU 202 should automatically execute the procedure for implementing standard ID set in the apparatus as initial operation. This successfully absorbs variation to occur when the apparatus is out of operation as well as the variation of surrounding conditions. Alternatively, the CPU 202 may execute the procedure when ID should be controlled to a value input by the user on, e.g., an operation panel.

Figure 3:
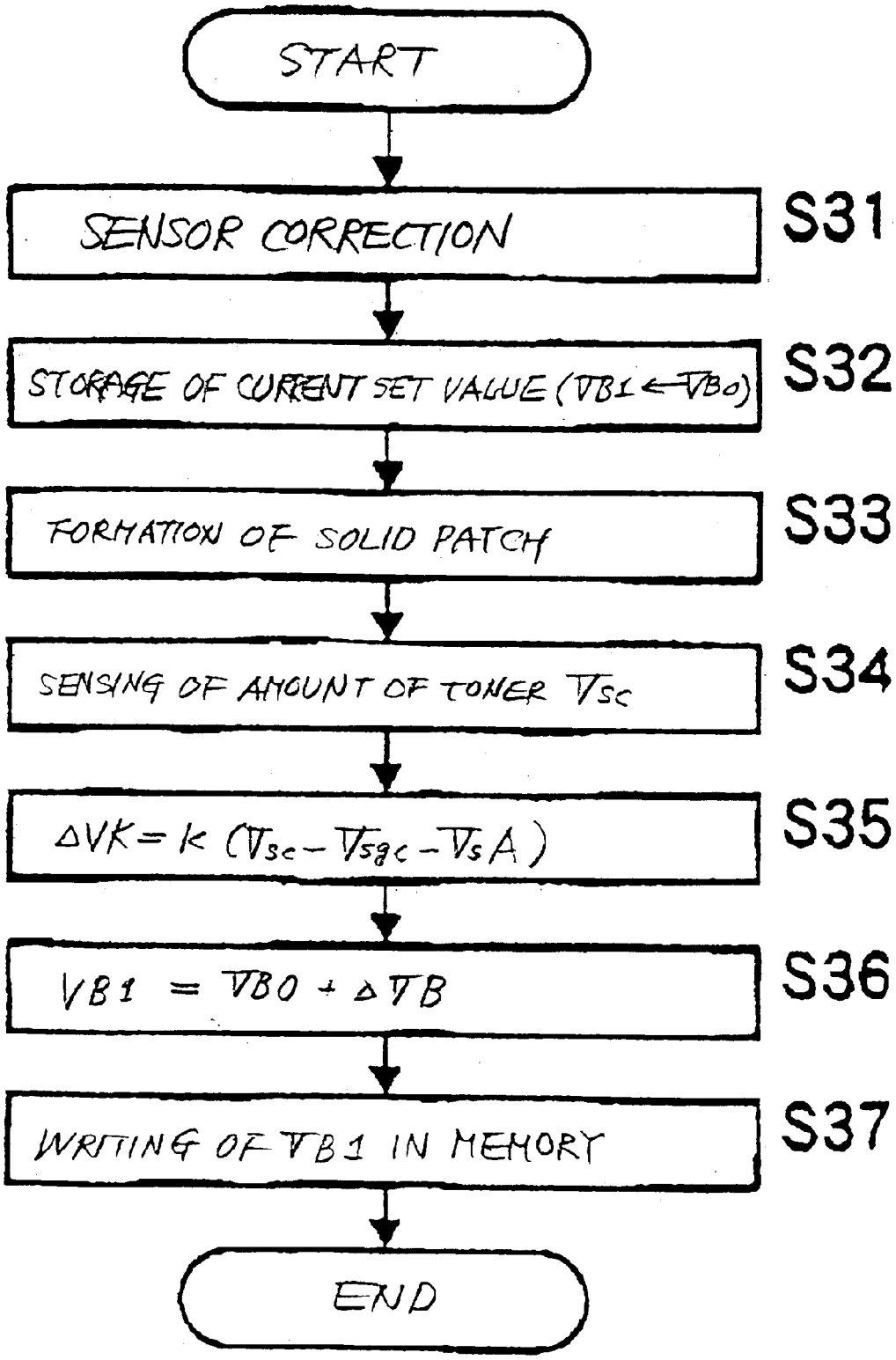
FIG. 3 is a flowchart demonstrating a specific operation of the illustrative embodiment.

FIG. 3 demonstrates the control over the amount of toner deposition described above specifically. While FIG. 3 pertains to the control over the amount of M toner to deposit on the belt 1 under a developing bias VB, the same control applies to C and Y toner also. As shown, before the control over the amount of toner deposition, the CPU 202 corrects the toner deposition sensor 100 (simply sensor 100 hereinafter), as stated earlier (step S31). The CPU 202 then stores in a memory a value VB0 currently set in the development bias control unit 207 as a set value VB1 (step S32). The value VB0 is meant for the bias to be applied to the M developing unit 6*a* in this specific procedure.

Subsequently, the CPU 202 causes a solid test patch to be formed on the belt 1 with the value VB0 currently set as the set value BV1 (step S33). At this instant, the other set values currently set for determining image forming conditions, e.g., a grid bias and a quantity of light are directly used. The sensor 100 senses the amount of M toner deposited on the test patch and sends its output Vsc representative of the sensed amount to the CPU 202 (step S34). In response, the CPU 202 produces a difference between the sensor output Vsc and a sensor output Vsgc to appear when the M toner is absent on the belt 1. The difference Vsc−Vsgc is a variable satisfying the linear characteristic of the color toner shown in FIG. 4, i.e., an equation:

$$\text{amount of toner} = \text{proportional coefficient} \cdot (Vsc - Vsg) \quad \text{Eq. (1)}$$

In the Eq. (1), the proportional coefficient is about 0.4 in the illustrative embodiment. The variable is used at the time of calculation of the deviation of the bias to be finally produced, as will be described later specifically.

It is to be noted that the sensor output Vsgc appearing when the M toner is not deposited can be obtained at the same time as the sensing of the patch if the area outside of the patch is sensed.

Further, if the sensor 100 is corrected such that the Eq. (1) constantly holds, then there can also be determined the difference Vsc−Vsgc with respect to the target amount of toner to deposit on a solid image, which generally ranges from 0.6 mg/cm$^2$ to 1.0 mg/cm$^2$. This difference is produced as a value VsA corresponding to a target amount of deposition. In the illustrative embodiment, the target amount of toner to deposit on a solid image is 0.6 mg/cm$^2$ while the target VsA, i.e., (Vsc−Vsgc) is 1.6 V.

The control to the target amount of deposition unique to the illustrative embodiment is achievable if the amount of toner deposition and development bias are proportional, as stated with reference to FIG. 5. A development potential is a difference between a development bias VB and the surface potential VL of a photoconductive element. Therefore, if the surface potential VL is constant, then the amount of toner deposition M/A is proportional to the development bias VB. The surface potential VL is a potential after exposure that is generally between 50 V and 100 V, and rises by about 50 V with the elapse of time. Further, the surface potential VT drops in a low temperature, low humidity (LL) environment (usually 10° C. and 15%) or rises in a high temperature, high humidity (HH) environment (usually 27° C. and 80%). Today, however, two-level optical writing is predominant and has made control over the quantity of light simple. Under such circumstances, the surface potential VL is considered to vary little and be constant. It follows that the surface potential VL has little influence on the slope of the characteristic curve shown in FIG. 5. Particularly, in the case of toner as distinguished from a toner and carrier mixture, the slope of FIG. 5 is more stable because no consideration should be given to the "toner content of a developer".

Figure 6:
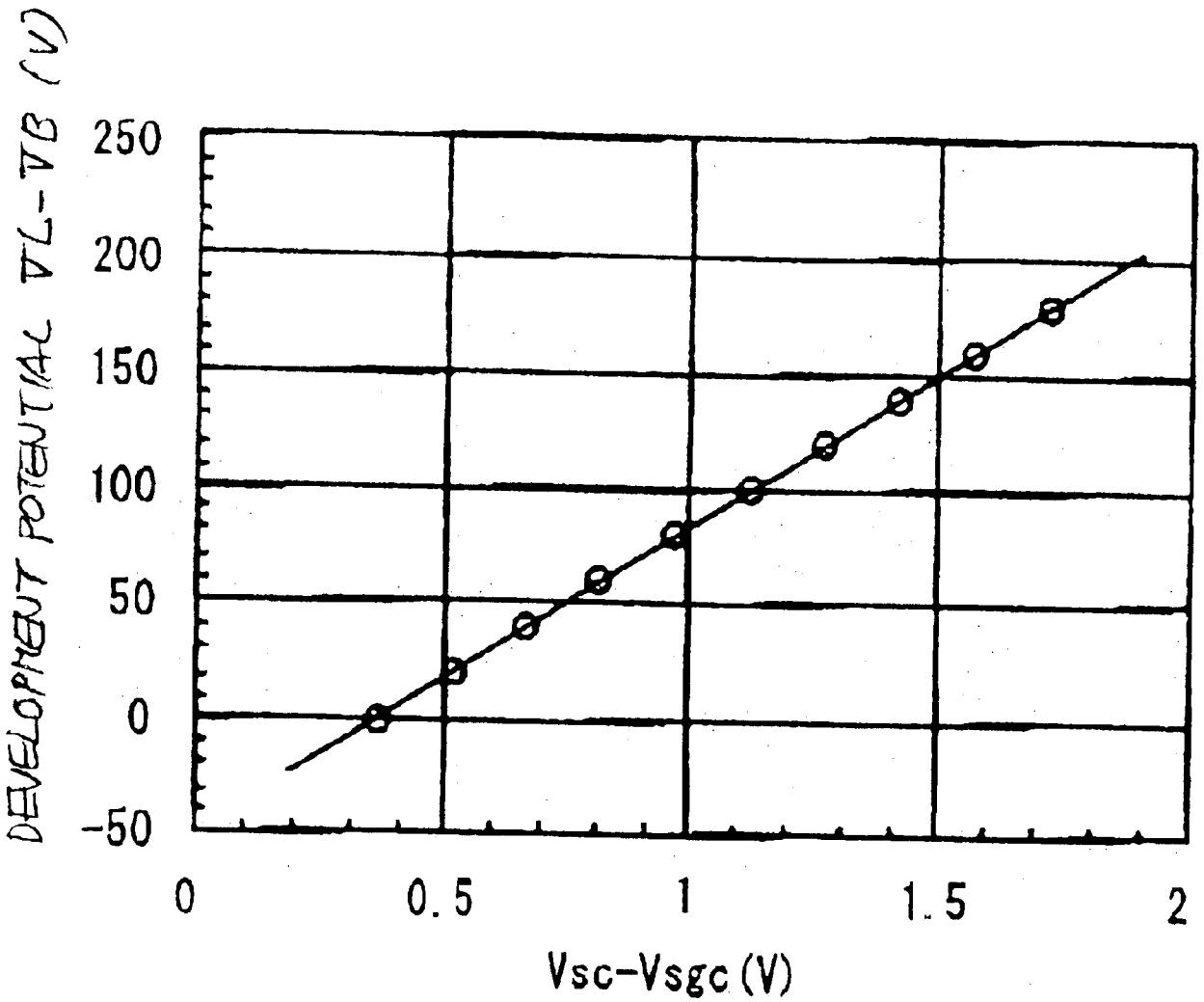
FIG. 6 is a graph showing a relation between the development potential and the sensor output particular to the illustrative embodiment.

As shown in FIG. 6, so long as the amount of toner deposition M/A is proportional to the bias VB for development, the bias and the amount of toner deposition sensed by the sensor 100 are also linearly related to each other, as expressed as:

$$\text{bias} = \text{proportional coefficient} \cdot \text{amount of toner} \quad \text{Eq. (2)}$$

Therefore, the deviation ΔVB of the bias for implementing the target amount of deposition from the bias used to form the test patch is produced by:

$$\begin{aligned} \Delta VB &= \text{proportional coefficient} \cdot \text{deviation of deposition} \quad \text{Eq. (3)} \\ &\quad (= \text{amount deposited on test patch} - \text{target amount}) \\ &= k(Vsc - Vsgc - VsA) \end{aligned}$$

In the illustrative embodiment, the proportional coefficient k included in the Eq. (3) and corresponding to the slope of FIG. 6 is 133. Therefore, to achieve the target amount of toner deposition, it is necessary to determine the deviation VB of the bias for development. This is done in a step S35 by using the Eq. (3). The target amount of deposition is assumed to be the value VsA based on the sensor output, as stated above.

In a step S36 following the step S35, the deviation VB is added to the currently set value VB0 to thereby determine a value VB1 to be newly set:

$$VB1 = VB0 + \Delta VB \quad \text{Eq. (4)}$$

Subsequently, the CPU 202 substitutes the value VB1 produced by the Eq. (4) for the value currently set in the development bias control unit 207. At the same time, the CPU 202 writes the new value VB1 in the NVRAM 209 (step S37) and then ends the procedure.

The above procedure executed in the linear characteristic range is not feasible for the Bk toner whose characteristic saturates in the great deposition range, as shown in FIG. 4. However, the procedure is applicable to all colors, inclusive of black, in a range in which the characteristic remains linear. While the illustrative embodiment has concentrated on toner, i.e., a single-ingredient type developer, it is practicable even with a two-ingredient type developer of the kind implementing the conditions described above.

In summary, it will be seen that an image forming apparatus of the present invention is capable of accurately controlling the amount of toner deposition with a single patch and therefore in a short period of time with a minimum amount of toner deposition. Further, the apparatus minimizes the variation of a set value and thereby stably controls toner deposition to an optimal amount. This successfully obviates the fall of image quality and defective images and insures stable without regard to the elapse of time. Moreover, the apparatus brings the actual value to a target value and thereby enhances the above advantages. In addition, the apparatus accurately, simply corrects sensing means.

Various modifications will become possible for those skilled in the art after receiving the teachings of the present disclosure without departing from the scope thereof.

What is claimed is:

1. An image forming apparatus comprising:

an image carrier on which a developer is to be deposited by an electrophotographic system;

control means for controlling an amount of the developer to deposit on said image carrier by varying a development potential;

reflection type sensing means made up of a light source and a light-sensitive device for sensing the amount of the developer deposited on said image carrier; and adjusting means for adjusting a set value set in said control means for controlling the amount of the developer to a target value;

wherein said sensing means uses a diffuse reflection system and has a correcting function; and said adjusting means causes said sensing means to sense the amount of the developer deposited on a test patch, which is formed on the basis of a preselected set value, and then calculates an adjustment value of the set value on the basis of said amount sensed by said sensing means and the target value.

2. The apparatus as claimed in claim 1, wherein said preselected set value is a current set value.

3. The apparatus as claimed in claim 2, wherein said adjusting means calculates the adjustment value as a value proportional to a difference between the amount sensed by said sensing means and the target value.

4. The apparatus as claimed in claim 3, wherein the correcting function of said sensing means performs correction on the basis of a value sensed when the developer is not deposited and a saturation value sensed when said developer is deposited.

5. The apparatus as claimed in claim 4, further comprising developing means using a single-ingredient type developer.

6. The apparatus as claimed in claim 1, wherein said adjusting means calculates the adjustment value as a value proportional to a difference between the amount sensed by said sensing means and the target value.

7. The apparatus as claimed in claim 1, wherein the correcting function of said sensing means performs correction on the basis of a value sensed when the developer is not deposited and a saturation value sensed when said developer is deposited.

8. The apparatus as claimed in claim 1, further comprising developing means using a single-ingredient type developer.

* * * * *